US006105541A

United States Patent [19]

Berlinger

[11] Patent Number: 6,105,541

[45] Date of Patent: Aug. 22, 2000

[54] FREE PISTON INTERNAL COMBUSTION ENGINE WITH ROTATING PISTON

[75] Inventor: Willibald G. Berlinger, Peoria, Ill.

[73] Assignee: Caterpillar, Inc., Peoria, Ill.

[21] Appl. No.: 09/255,208

[22] Filed: Feb. 22, 1999

[51] Int. Cl.[7] ..... F02B 71/00

[52] U.S. Cl. ..... 123/46 R; 123/46 SC

[58] Field of Search ..... 123/46 R, 46 SC, 123/193.6, 193.4

[56] References Cited

U.S. PATENT DOCUMENTS

| | | | |
|---|---|---|---|
| 3,044,452 | 7/1962 | McCrory et al. | 123/46 SC |
| 3,606,591 | 9/1971 | Fotma | 123/46 SC |
| 3,610,217 | 10/1971 | Braun | 123/46 SC |
| 4,705,460 | 11/1987 | Braun | 123/46 SC |
| 5,473,893 | 12/1995 | Acten et al. | 123/46 SC |
| 5,482,445 | 1/1996 | Achten et al. | 123/46 SC |

*Primary Examiner*—Marguerite McMahon
*Assistant Examiner*—Jason Benton
*Attorney, Agent, or Firm*—Todd Taylor

[57] ABSTRACT

A free piston internal combustion engine includes a housing with a combustion cylinder and a compression cylinder. A fluid inlet port is disposed in communication with the compression cylinder for transporting a pressurized fluid into the compression cylinder. A piston includes a piston head reciprocally disposed within the combustion cylinder, a compression head reciprocally disposed within the compression cylinder, and a plunger rod attached to each of and interconnecting the piston head and the compression head. The compression head includes a plurality of radially extending vanes which are positioned to be at least intermittently disposed in association with the fluid inlet port, whereby pressurized fluid which is transported into the compression cylinder from the fluid inlet port causes the piston to rotate.

16 Claims, 1 Drawing Sheet

FREE PISTON INTERNAL COMBUSTION ENGINE WITH ROTATING PISTON

TECHNICAL FIELD

The present invention relates to free piston internal combustion engines, and, more particularly, to piston and cylinder configurations within such engines.

BACKGROUND ART

Free piston internal combustion engines include one or more pistons which are reciprocally disposed within corresponding combustion cylinders. However, the pistons are not interconnected with each other through the use of a crankshaft. Rather, each piston is typically rigidly connected with a plunger rod which is used to provide some type of work output. For example, the plunger rod may be used to provide electrical power output by inducing an electrical current, or fluid power output such as pneumatic or hydraulic power output. In a free piston engine with a hydraulic output, the plunger is used to pump hydraulic fluid which can be used for a particular application. Typically, the housing which defines the combustion cylinder also defines a hydraulic cylinder in which the plunger is disposed and an intermediate compression cylinder between the combustion cylinder and the hydraulic cylinder. The combustion cylinder has the largest inside diameter; the compression cylinder has an inside diameter which is smaller than the combustion cylinder; and the hydraulic cylinder has an inside diameter which is still yet smaller than the compression cylinder. A compression head which is attached to and carried by the plunger at a location between the piston head and plunger head has an outside diameter which is just slightly smaller than the inside diameter of the compression cylinder. A high pressure hydraulic accumulator which is fluidly connected with the hydraulic cylinder is pressurized through the reciprocating movement of the plunger during operation of the free piston engine. An additional hydraulic accumulator is selectively interconnected with the area in the compression cylinder to exert a relatively high axial pressure against the compression head and thereby move the piston head toward the top dead center (TDC) position.

With conventional free piston engines, each piston is reciprocally disposed within a corresponding combustion cylinder, but is not rotated within the combustion cylinder. As the piston moves from a TDC position toward a bottom dead center (BDC) position, the piston head moves past and uncovers the exhaust outlet to allow the combustion products within the combustion chamber to flow therefrom. Since the piston head does not rotate within the combustion cylinder, the same portion of the piston head is continually disposed adjacent to the exhaust outlet. The portion of the piston head adjacent to the exhaust outlet has been found to have higher temperatures when compared with other portions of the piston head (e.g., when compared with the portion of the piston head adjacent to the combustion area inlet associated with the air scavenging channel). These thermal gradients and distortions of the piston head may cause thermal fatigue of the piston head over time, resulting in a decreased life expectancy of the piston head.

The present invention is directed to overcoming one or more of the problems as set forth above.

SUMMARY OF THE INVENTION

The present invention provides a free piston internal combustion engine with a piston which rotates during use.

In one aspect of the invention, a free piston internal combustion engine includes a housing with a combustion cylinder and a compression cylinder. A fluid inlet port is disposed in communication with the compression cylinder for transporting a pressurized fluid into the compression cylinder. A piston includes a piston head reciprocally disposed within the combustion cylinder, a compression head reciprocally disposed within the compression cylinder, and a plunger rod attached to each of and interconnecting the piston head and the compression head. The compression head includes a plurality of radially extending vanes which are positioned to be at least intermittently disposed in association with the fluid inlet port, whereby pressurized fluid which is transported into the compression cylinder from the fluid inlet port causes the piston to rotate.

An advantage of the present invention is that the piston rotates during use to prevent thermal fatigue of the portion of the piston head which is adjacent to the exhaust outlet.

Another advantage is that the rotating piston inhibits uneven wear between the piston head and combustion cylinder wall.

Yet another advantage is that the piston is rotated without requiring additional power input to the system.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figures 1, 2:
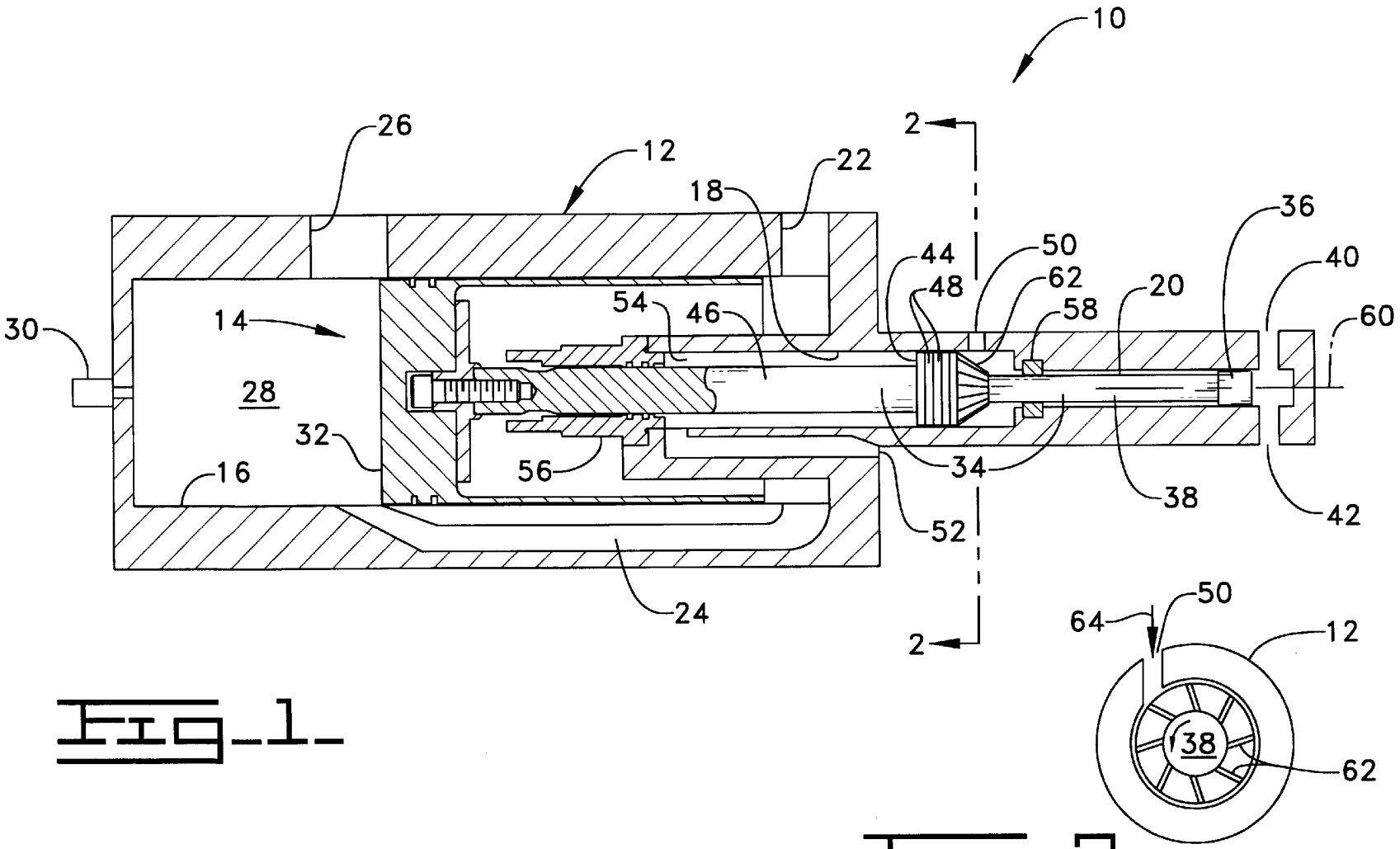
FIG. 1 is a simplified side, sectional view of a portion of a free piston internal combustion engine of the present invention.
FIG. 2 is a sectional view taken at line 2—2 in FIG. 1.

Referring now to the drawings, and more particularly to FIG. 1, there is shown a simplified side, sectional view of an embodiment of a portion of a free piston internal combustion engine 10 including a housing 12 and piston 14.

Housing 12 generally includes a combustion cylinder 16, compression cylinder 18 and hydraulic cylinder 20. Housing 12 also includes a combustion air inlet 22, air scavenging channel 24 and exhaust outlet 26 which are disposed in communication with a combustion chamber 28 within combustion cylinder 16. Combustion air is transported through combustion air inlet 22 and air scavenging channel 24 into combustion chamber 28 when piston 14 is at or near a BDC position. An appropriate fuel, such as a selected grade of diesel fuel, is injected into combustion chamber 28 as piston 14 moves toward a TDC position using a controllable fuel injector system, shown schematically and referenced as 30. The stroke length of piston 14 between a BDC position and a TDC position may be fixed or variable.

Piston 14 is reciprocally disposed within combustion cylinder 28 and generally includes a piston head 32 which is attached to a plunger rod 34. A plunger head 36 is attached to a smaller diameter portion 38 of plunger rod 34 at an end generally opposite from piston head 32. Hydraulic cylinder 20 is disposed in communication with each of an inlet port 40 and an outlet port 42 in housing 12. Reciprocating movement of plunger head 36 within hydraulic cylinder 20 causes hydraulic fluid to be drawn into hydraulic cylinder 20 through inlet port 40 from a source of hydraulic fluid, such as a low pressure hydraulic accumulator (not shown), on a compression stroke of piston 14; and causes pressurized hydraulic fluid to be discharged from outlet port 42 to a high pressure hydraulic accumulator (not shown) on a return stroke of piston 14.

A compression head 44 is disposed between piston head 32 and plunger head 36, and interconnects smaller diameter portion 38 with a larger diameter portion 46 of plunger rod 34. Reciprocating movement of piston head 32 between a BDC position and a TDC position, and vice versa, causes corresponding reciprocating motion of compression head 44 within compression cylinder 18. Compression head 44 includes a plurality of sequentially adjacent lands and valleys 48 which effectively seal with and reduce friction between compression head 44 and an inside surface of compression cylinder 18. Compression cylinder 18 is disposed in communication with fluid ports 50 and 52 generally at opposite ends thereof. Pressurized fluid which is transported into compression cylinder 18 on a side of compression head 44 adjacent to fluid port 50 causes piston 14 to move toward a TDC position during a compression stroke. Conversely, pressurized fluid may be transported through fluid port 52 into compression cylinder 18 in an annular space 54 surrounding larger diameter portion 46 to effect a return stroke of piston 14 at the initial start up or upon the occurrence of a misfire.

Combustion cylinder 16 is separated from compression cylinder 18 using an annular bearing/seal 56 which surrounds larger diameter portion 46 of plunger rod 34. Bearing/seal 56 allows sliding movement of larger diameter portion 46 therethrough, while at the same time supporting larger diameter portion 46 in a radial direction. Similarly, compression cylinder 18 is separated from hydraulic cylinder 20 using an annular bearing/seal 58. Bearing/seal 58 allows sliding movement of smaller diameter portion 38 of plunger rod 34, while at the same time radially supporting smaller diameter portion 38. Since plunger rod 34 is slidingly carried by the pair of annular bearing/seals 56 and 58, it will be appreciated that the longitudinal axis 60 of plunger rod 34 extends through the center of each of bearing/seals 56 and 58.

According to the present invention, piston 14 is provided with a flow impingement device which is configured to at least intermittently be disposed in association with fluid port 50 when pressurized fluid is transported through fluid port 50 into compression cylinder 54. The pressurized fluid impinges upon the flow impingement device of piston 14 and causes piston 14 to rotate during use.

More particularly, compression head 44 of piston 14 includes a plurality of radially extending vanes 62 disposed on an end face thereof which is adjacent to smaller diameter portion 38 of plunger rod 34. When piston 14 is at or near a BDC position, vanes 62 of compression head 44 are disposed within the flow path of pressurized fluid which is transported through fluid port 50 into compression cylinder 18, as indicated by fluid flow line 64 in FIG. 2. The pressurized fluid may be pulsed through fluid port 50 from a hydraulic accumulator (not shown) which is attached therewith. Suitable valving (not shown) between the hydraulic accumulator and fluid port 50 is selectively actuated using a control system (not shown) to effect a compression stroke of piston 14. With the present invention, the pressurized fluid flowing through fluid port 50 not only provides the function of effecting the compression stroke, but also simultaneously provides the function of rotating piston 14 a limited extent depending upon the geometry of vanes 62 and the pressure and duration of the fluid pulse which impinges upon vanes 62.

The exact geometry of vanes 62 may vary depending upon the specific application of free piston engine 10. In the embodiment shown, vanes 62 are substantially identically configured with linear edges which are disposed at an acute angle relative to longitudinal axis 60 of plunger rod 34 (FIG. 1). Vanes 62 extend radially from longitudinal axis 60, but are slightly offset from the longitudinal axis 60 (FIG. 2). In other embodiments, vanes 62 may be disposed at a different angle relative to longitudinal axis 60; may have a curvature or compound curvature; and/or may be aligned with longitudinal axis 60 of plunger rod 34. Moreover, vanes 62 may be identically configured or differently configured from one vane to another. It will be appreciated that the specific geometry of vanes 62, the pressure and duration of the fluid pulse which is transported through fluid port 50, the alignment between vanes 62 and fluid port 50, and the flow directional path through fluid port 50 all may affect the degree of rotation of piston 14 with each pressure pulse and may be varied depending upon the specific application.

In the embodiment shown, piston 14 includes a flow impingement device which is integrally configured as part of compression head 44. However, it is also possible to configure another part of piston 14 with a flow impingement device which is placed within a flow path of pressurized fluid to cause piston 14 to rotate during use. For example, housing 14 could be formed with an additional fluid port (not shown) disposed adjacent to a plurality of vanes extending from larger diameter portion 46 of plunger rod 34 when piston 14 is at or near a BDC position. An additional pulse of pressurized fluid could be transported through the additional fluid port concurrently with the fluid pulse which is transported through fluid port 50. Other configurations of flow impingement devices associated with piston head 32, smaller diameter portion 38 and/or plunger head 36 are also possible.

INDUSTRIAL APPLICABILITY

During use, piston 14 is reciprocally disposed within combustion cylinder 16 and travels between a BDC position and a TDC position during a compression stroke, and between a TDC position and a BDC position during a return stroke. Combustion air is introduced into combustion chamber 28 through combustion air inlet 22 and air scavenging channel 24. Fuel is controllably injected into combustion chamber 28 using a fuel injector 30. When piston 14 is at or near a BDC position, a pulse of pressurized fluid is transported through fluid port 50 into compression cylinder 18. The pressurized fluid fills the portion of compression cylinder 18 surrounding smaller diameter portion 38 of plunger rod 34 and causes piston 14 to move toward a TDC position during a compression stroke. When the pulse of pressurized fluid is transported through fluid port 50, the pressurized fluid also impinges upon vanes 62 and causes rotation of piston 14 within housing 12. Each time that piston 14 is at or near a BDC position and the pressurized fluid is pulsed through fluid port 50, a rotational force is exerted on piston 14 which causes rotation of piston 14 within housing 12. Rotating piston 14 reduces thermal fatigue on piston head 32 and also reduces uneven wear between piston head 14 and combustion cylinder 16.

Other aspects, objects and advantages of this invention can be obtained from a study of the drawings, the disclosure and the appended claims.

What is claimed is:

1. A free piston internal combustion engine, comprising:

a housing including a combustion cylinder, a second cylinder, and a fluid port disposed in communication with said second cylinder for transporting a pressurized fluid into said second cylinder; and a piston including a piston head reciprocally disposed within said combustion cylinder, a second head reciprocally disposed within said second cylinder, and a plunger rod attached to each of and interconnecting said piston head and said second head, one of said second head and said plunger rod including a flow impingement device which is at least intermittently disposed in association with said fluid port, whereby pressurized fluid which is transported into said second cylinder from said fluid port causes said piston to rotate.

2. The free piston internal combustion engine of claim 1, wherein said second cylinder comprises a compression cylinder and said second head comprises a compression head.

3. The free piston internal combustion engine of claim 2, wherein said flow impingement device comprises a plurality of radially extending vanes on said compression head.

4. The free piston internal combustion engine of claim 3, wherein said radially extending vanes are disposed on an end face of said compression head.

5. The free piston internal combustion engine of claim 3, wherein said plunger rod has a longitudinal axis and said vanes are disposed at an acute angle relative to said longitudinal axis.

6. The free piston internal combustion engine of claim 3, wherein said plurality of vanes have one of a linear and curved profile.

7. The free piston internal combustion engine of claim 6, wherein said plurality of vanes have a linear profile.

8. The free piston internal combustion engine of claim 3, wherein each of said piston head and said second head are movable during a compression stroke to a top dead center position and during a return stroke to a bottom dead center position, and wherein said fluid port is positioned in said housing to cause pressurized fluid to impinge upon said vanes when said compression head is near said bottom dead center position.

9. The free piston internal combustion engine of claim 2, wherein said housing further includes a hydraulic cylinder and said piston further includes a plunger head reciprocally disposed within said hydraulic cylinder, said compression head disposed between said piston head and said plunger head.

10. A free piston internal combustion engine, comprising:

a housing including a combustion cylinder, a compression cylinder, and a fluid port disposed in communication with said compression cylinder for transporting a pressurized fluid into said compression cylinder;

a piston including a piston head reciprocally disposed within said combustion cylinder, a compression head reciprocally disposed within said compression cylinder, and a plunger rod attached to each of and interconnecting said piston head and said compression head, said compression head including a plurality of radially extending vanes which are positioned to be at least intermittently disposed in association with said fluid port, whereby pressurized fluid which is transported into said compression cylinder from said fluid inlet port causes said piston to rotate.

11. The free piston internal combustion engine of claim 10, wherein said radially extending vanes are disposed on an end face of said compression head.

12. The free piston internal combustion engine of claim 10, wherein said plunger rod has a longitudinal axis and said vanes are disposed at an acute angle relative to said longitudinal axis.

13. The free piston internal combustion engine of claim 10, wherein said plurality of vanes have one of a linear and curved profile.

14. The free piston internal combustion engine of claim 13, wherein said plurality of vanes have a linear profile.

15. The free piston internal combustion engine of claim 10, wherein each of said piston head and said compression head are movable during a compression stroke to a top dead center position and during a return stroke to a bottom dead center position, and wherein said fluid port is positioned in said housing to cause pressurized fluid to impinge upon said vanes when said compression head is near said bottom dead center position.

16. The free piston internal combustion engine of claim 10, wherein said housing further includes a hydraulic cylinder and said piston further includes a plunger head reciprocally disposed within said hydraulic cylinder, said compression head disposed between said piston head and said plunger head.

* * * * *